US007984822B2

(12) United States Patent
Watson et al.

(10) Patent No.: US 7,984,822 B2
(45) Date of Patent: Jul. 26, 2011

(54) KILN LID LIFT APPARATUS

(75) Inventors: John D. Watson, Sand Point, MI (US); Diane C. Watson, legal representative, Sand Point, MI (US); Michael D. Kelly, Sand Point, MI (US)

(73) Assignee: Evenheat Kiln, Inc., Caseville, MI (US)

( * ) Notice: Subject to any disclaimer, the term of this patent is extended or adjusted under 35 U.S.C. 154(b) by 0 days.

(21) Appl. No.: 12/768,399

(22) Filed: Apr. 27, 2010

(65) Prior Publication Data

US 2010/0209865 A1 Aug. 19, 2010

Related U.S. Application Data

(63) Continuation of application No. 11/637,581, filed on Dec. 12, 2006, now abandoned.

(51) Int. Cl.
*B65D 43/24* (2006.01)
*B65D 51/18* (2006.01)

(52) U.S. Cl. ..... 220/828; 220/254.5; 220/254.6

(58) Field of Classification Search ..... 220/284, 220/260, 259.1, 256.1, 255, 254.6, 254.5, 220/254.3, 254.1, 830, 828, 827, 810, 819, 220/817, FOR. 192, FOR. 207, FOR. 204, 220/FOR. 203, 908; 432/250; 248/147, 248/213.2, 213.1; 211/83; 414/917
See application file for complete search history.

(56) References Cited

U.S. PATENT DOCUMENTS

| | | | | | |
|---|---|---|---|---|---|
| 1,511,982 | A | * | 10/1924 | Schilling | 40/606.05 |
| 1,845,883 | A | * | 2/1932 | Mandel | 248/147 |
| 1,947,879 | A | * | 2/1934 | Sandberg et al. | 248/147 |
| 2,862,683 | A | * | 12/1958 | Dunagan et al. | 248/147 |
| 3,224,595 | A | * | 12/1965 | Sherley | 211/83 |
| 3,347,507 | A | * | 10/1967 | Dyer | 248/147 |
| 3,558,088 | A | * | 1/1971 | Sherley | 248/147 |
| 3,825,215 | A | * | 7/1974 | Borglum | 248/147 |
| 3,885,700 | A | * | 5/1975 | Allard | 220/263 |
| 3,924,778 | A | * | 12/1975 | Sorensen | 220/314 |
| 4,389,191 | A | * | 6/1983 | Lowe | 432/250 |
| 4,921,119 | A | * | 5/1990 | Goad et al. | 220/212 |
| 5,763,965 | A | * | 6/1998 | Bader | 310/12.06 |
| 5,910,006 | A | * | 6/1999 | Conroy et al. | 432/250 |
| 2004/0187698 | A1 | * | 9/2004 | Parenteau | 99/337 |

* cited by examiner

*Primary Examiner* — Mickey Yu
*Assistant Examiner* — Robert J Hicks
(74) *Attorney, Agent, or Firm* — Miller Canfield, Paddock and Stone, P.L.C.; Timothy J. Engling

(57) ABSTRACT

A kiln having a body with an internal chamber accessible via an opening which normally is closed by a closure that is movable. Lift apparatus effects movements of the closure between its closed and opened positions. The lift apparatus includes an arm which overlies the closure and is pivoted to a support independently of the kiln body for rotation about a second axis that is spaced a selected distance from the axis about which the closure rocks. The lift arm is connected to the closure by a pivot coupling which maintains the lift arm and the closure substantially parallel and uniformly spaced apart throughout the movements of the closure. The pivotal connection of the lift arm to the closure enables relative movement of the lift arm and the closure during movements thereof to avoid imposing appreciable stress on either the arm or the closure.

20 Claims, 5 Drawing Sheets

KILN LID LIFT APPARATUS

CROSS-REFERENCE TO RELATED APPLICATION

This application is a continuation of U.S. application Ser. No. 11/637,581, filed Dec. 12, 2006, which is incorporated herein by reference.

BACKGROUND OF THE APPARATUS

This invention relates to apparatus for use in moving a ceramic or glass kiln lid between open and closed positions.

Kilns of the kind used in the manufacture of ceramic or glass items conventionally have a body provided with a chamber in which the items may be fired. Access to the chamber is provided via an opening, and such opening is selectively opened and closed by a closure or lid which is pivoted on the body for movements between its open and closed positions.

It is conventional to provide a lid or closure lift structure which, for convenience, is fixed to some part of the kiln body. In those instances in which the kiln closure is pivotable between its open and closed positions the movement of the closure frequently imposes stresses on the closure or the kiln body, or both. Over time, these stresses can produce severe damage to the kiln body, the closure, the hinge structure, or all such components.

In providing apparatus for minimizing the effects of stresses imposed during the opening and closing of a kiln closure, it is possible that the closure and kiln body may not be capable of accommodating dimensional changes that occur during temperature variations resulting from the operation of the kiln. In those instances in which a closure must be forcibly maintained in closed condition, such result usually is ensured by the use of locking or latching mechanisms. These mechanisms, however, may adversely affect the ability of the closure and the kiln to accommodate dimensional changes due to variations in temperature, thereby imposing additional stress on the closure, the kiln body, or the closure hinge structure.

A principal object of the invention is to provide a kiln body, a closure, a kiln support, and lift apparatus for moving the closure between open and closed positions and which avoids the imposition of stresses of the kind resulting from the use of mechanisms in use heretofore.

BRIEF SUMMARY

Closure lift apparatus constructed in accordance with a preferred embodiment of the invention comprises a base on which a kiln may be supported. A kiln includes a body having a chamber therein to which access may be had via an opening. The kiln includes a closure or lid pivotally mounted on the kiln body for rocking movements about an axis between the closed and opened positions. In many instances the kiln closure is quite heavy. To avoid a person's having to lift a heavy weight, closure lift apparatus is provided to facilitate movements of the closure between opened and closed positions.

The closure lift apparatus has an upstanding support which is mounted on the base, rather than on the kiln body. At the upper end of the support is pivoted a lift arm which substantially parallels the base. The support is of such height as to enable the lift arm to overlie the kiln body and the closure when the latter is in its closed position. The lift arm is pivoted to the support for rocking movements about an axis which is spaced from the axis of rocking movements of the kiln closure. Consequently, rocking movements of the lift arm and the closure are on different radii as a result of which the paths of movement of the closure and the lift arm are different. To avoid the imposition of stresses on the arm, the closure, and the coupling therebetween during these rocking movements the lift arm and the closure must be capable of movement relative to each other.

The lift arm and the closure move concurrently. To avoid requiring a person to overcome the weight of both the lift arm and the closure to effect movement thereof, the lift arm and the closure are counterbalanced.

To minimize the possibility of inadvertent movement of the closure from its open position to its closed position, a manually operable prop or stabilizer is provided.

THE DRAWINGS

THE DISCLOSED EMBODIMENT

Figure 1:
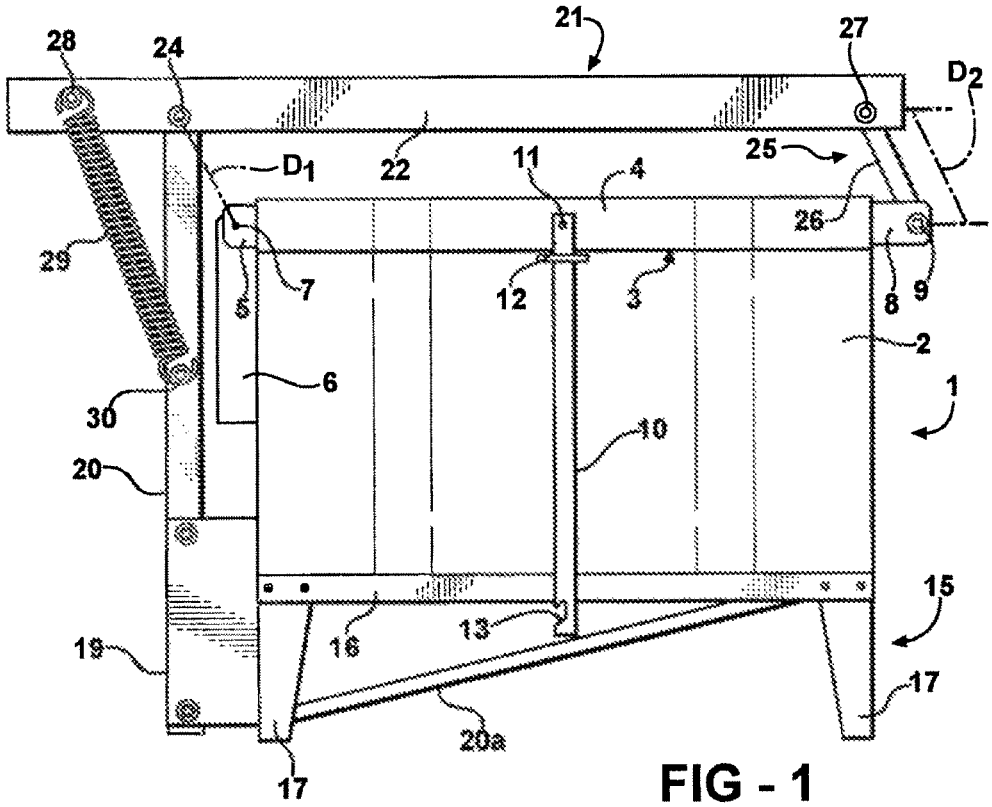
FIG. 1 is a side elevational view of a kiln having a pivotally movable closure occupying its closed position, a pivotally movable lift arm, a support for the lift arm, and a coupling between the lift arm and the closure.

Apparatus constructed in accordance with the disclosed embodiment of the invention is adapted for use with a conventional ceramic kiln 1 having a body 2 within which is a chamber for the accommodation of ceramic items that are to be fired. Access to the chamber may be had through a top opening which may be opened or closed by a closure 3 comprising a lid 4 having brackets 5 which cooperate with brackets 6 for the accommodation of a pivot pin 7 constituting a first axis. The lid 4 may rock about the first axis from the closed position shown in FIG. 1 to the opened position shown in FIG. 3. The closure 3 also has brackets 8 at its opposite end for the accommodation of a coupling rod 9. The lid 4 is substantially planar.

A stabilizer bar 10 is pivoted at one end thereof to the lid 4 by a pivot pin 11 and extends through a retainer loop 12. The opposite end of the stabilizer bar 10 has a notch 13 therein which may accommodate a portion of the retainer loop 12 when the closure is in the opened or raised position shown in FIG. 3 to provide support for the closure and minimize the likelihood of its moving inadvertently to its closed position.

Except for the bracket 8 and coupling rod 9 the apparatus thus far described is conventional.

Figure 2:
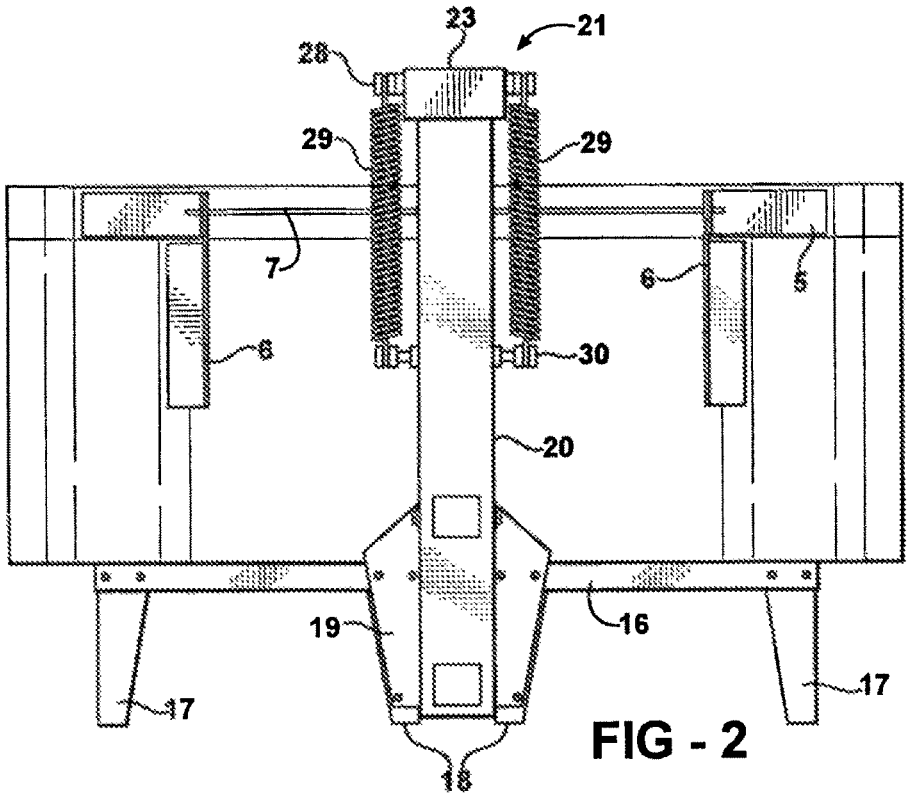
FIG. 2 is a rear elevational view of the apparatus shown in FIG. 1.

The apparatus includes a base 15 having a support member 16 on which the bottom of the kiln body 1 may seat. The base also includes two pairs of supporting legs 17 and two additional supporting legs 18 between two of the legs 17. See FIG. 2. The legs 18 and the member 16 provide support for a bracket 19 from which an upright support 20 extends to a level above that of the lid 4 when the latter is in its closed position. A brace 20*a* reinforces the bracket 19.

Figure 3:
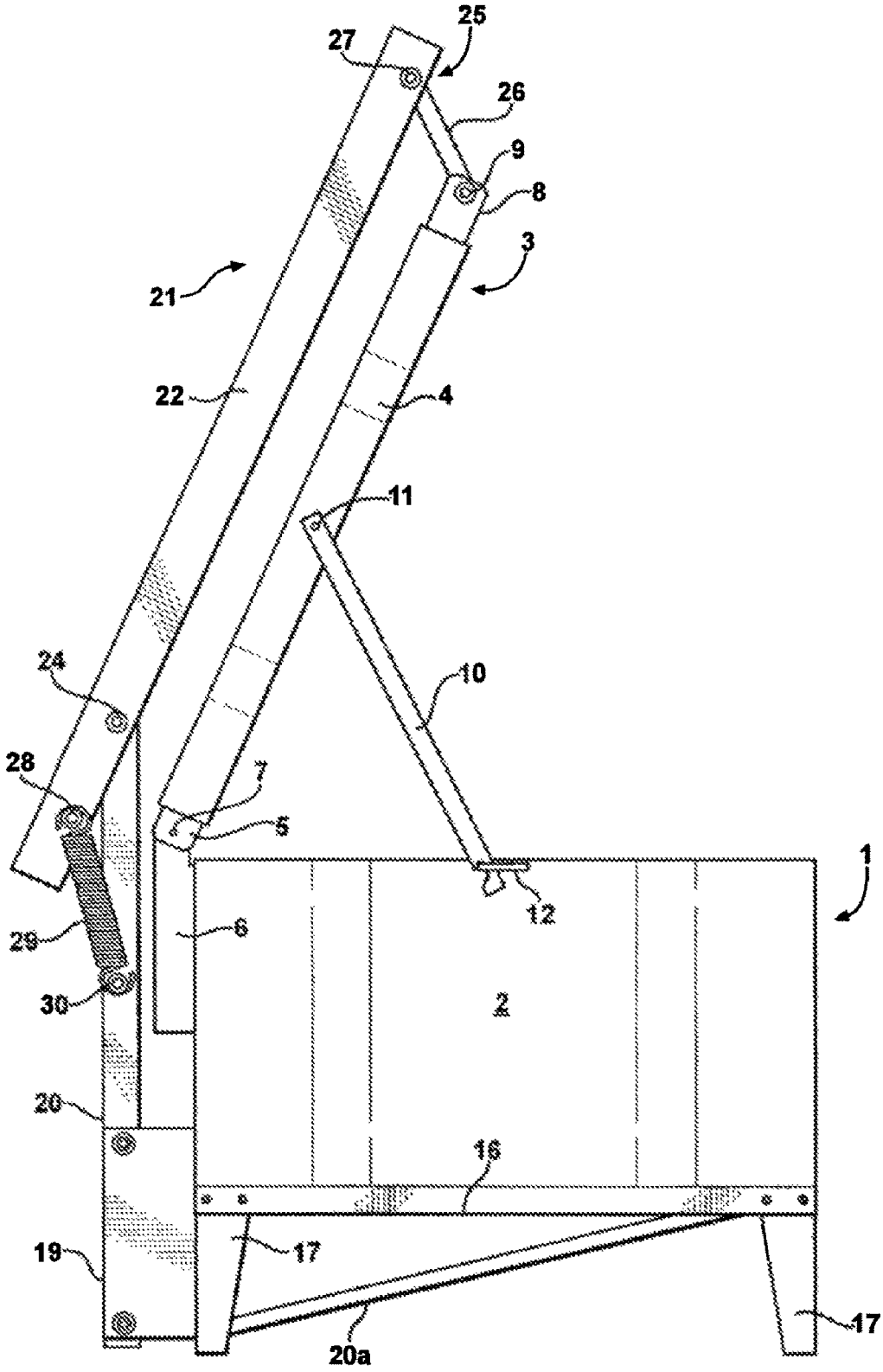
FIG. 3 is a view similar to FIG. 1, but illustrating the lift arm and the closure in adjusted positions.
Figure 4:
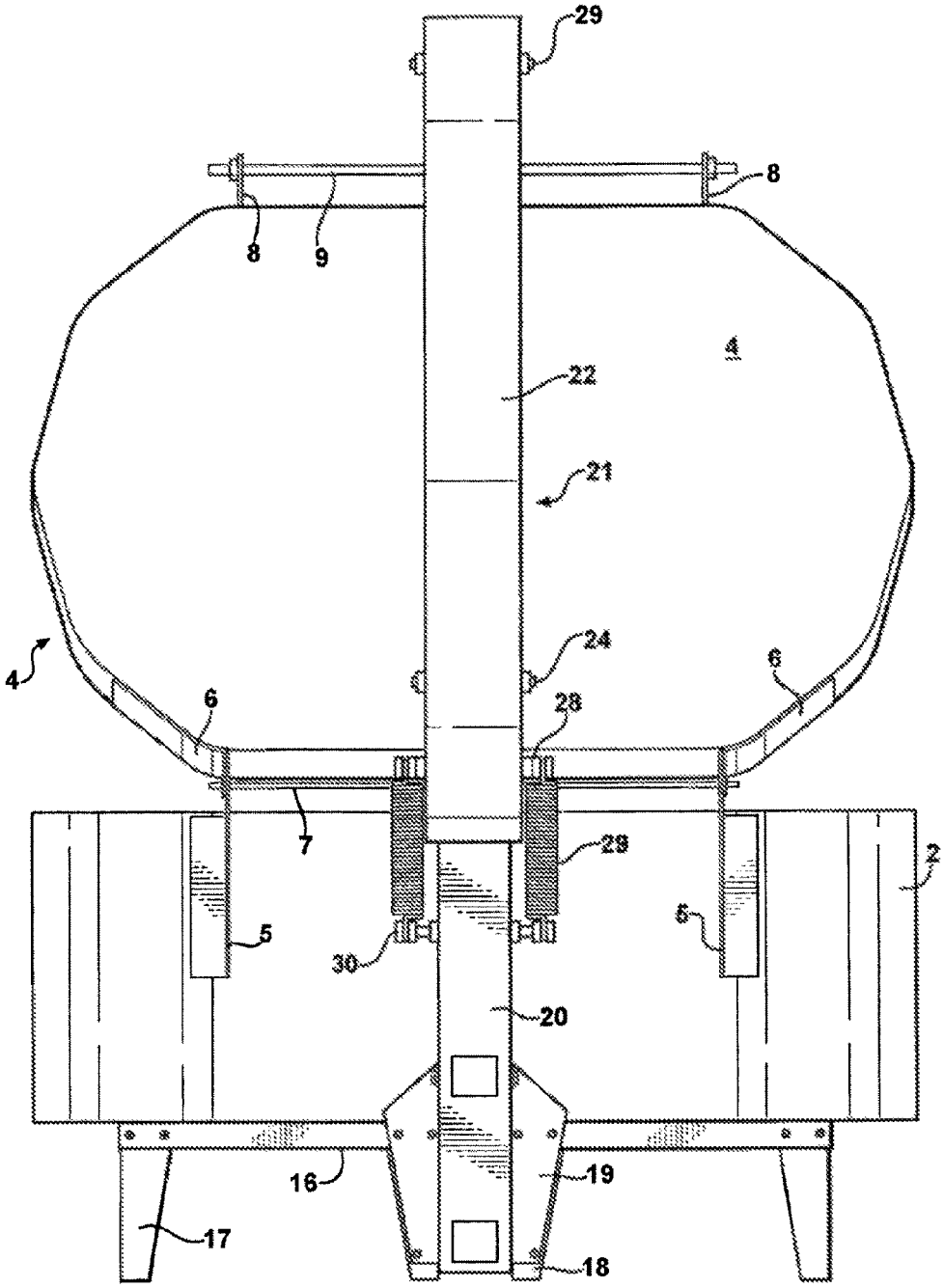
FIG. 4 is a rear elevational view of the apparatus in the positions shown in FIG. 3.
Figure 5:
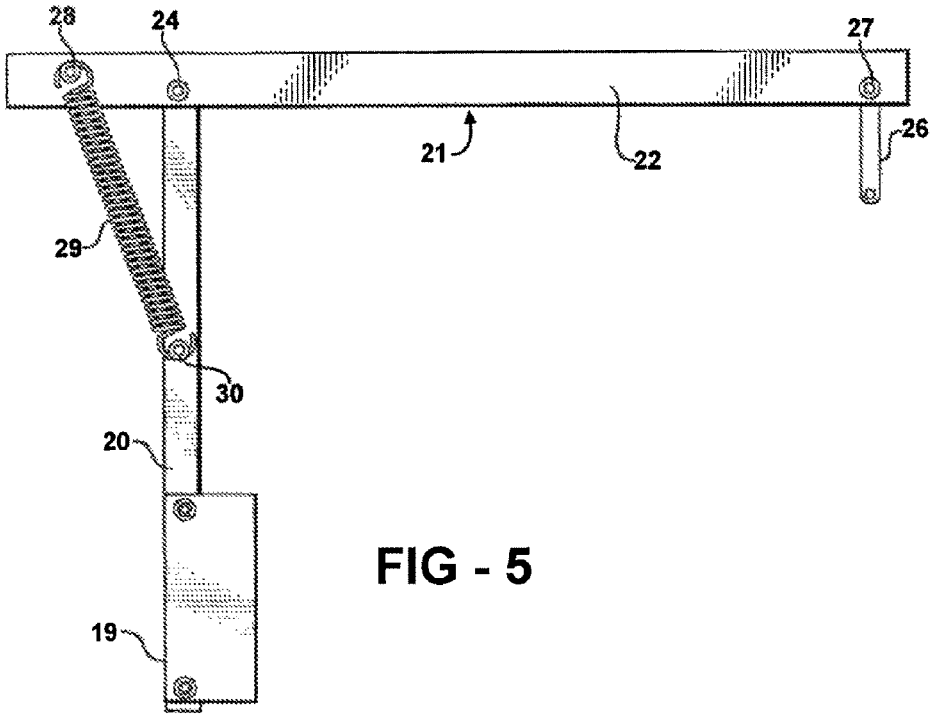
FIG. 5 is a side elevational view of the lift apparatus itself and the coupling by which the lift arm may be coupled to the kiln closure.
Figure 7:
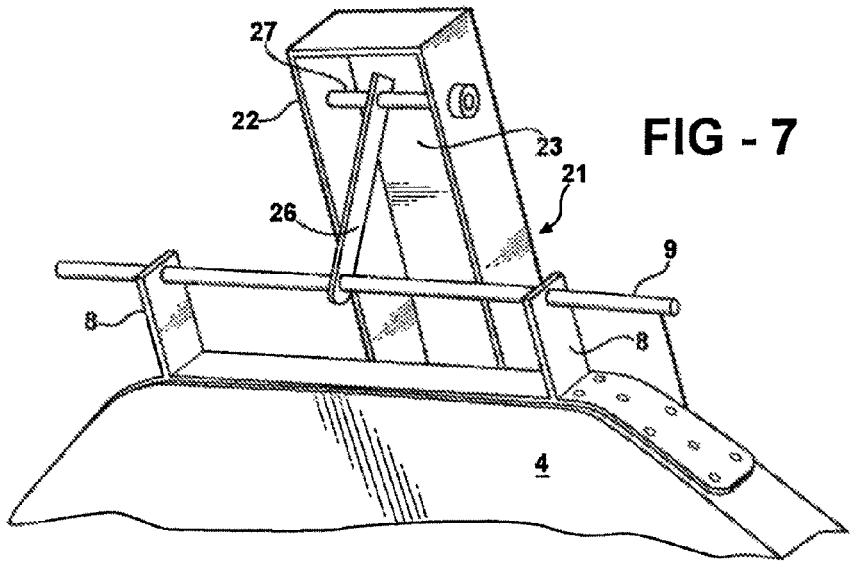
FIG. 7 is an enlarged, fragmentary, isometric view illustrating the coupling of the lift arm to the kiln closure.
Figure 6:
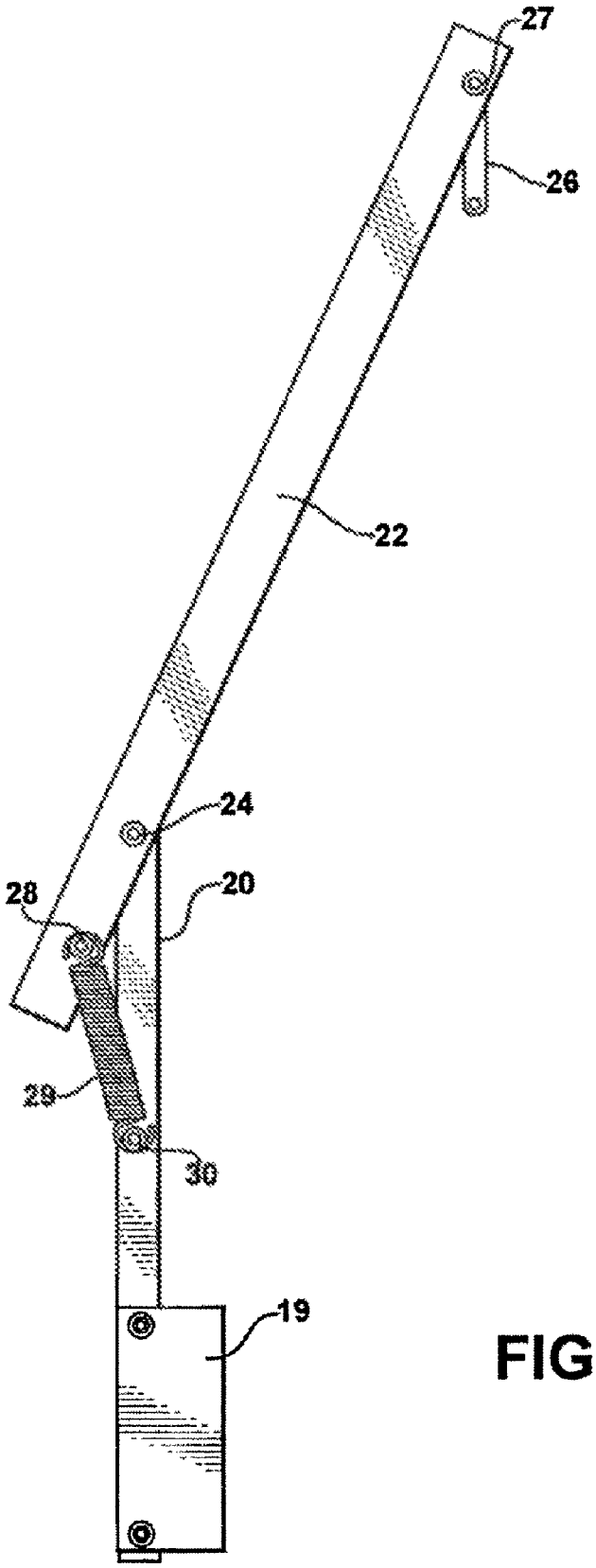
FIG. 6 is a view similar to FIG. 5, but illustrating the parts in adjusted positions.

A channel shaped, planar lift arm 21 has a pair of spaced, parallel sides 22 bridged by a web 23. Adjacent, but spaced from, one end of the arm 21 is a pivot pin 24 which provides a pivotal connection of the arm 21 to the support 20, thereby providing a pivotal axis about which the arm 21 may rock. As is best shown in FIGS. 1 and 3, the axes formed by the pivot pins 7 and 24 are vertically and laterally spaced apart along an imaginary line inclined to the vertical. The spacing between the pivots is a fixed distance indicated in FIG. 1 at $D_1$.

Adjacent the opposite end of the arm 21 is a coupling 25 comprising a link 26 pivoted to the lid 4 by means of the rod 9 and to the arm 21 by means of a pivot pin 27. The effective length of the coupling 25 is designated $D_2$ (FIG. 1), and such length corresponds to that designated $D_1$. The arm 21 thus is rockable relative to the kiln and the support 20 about the axis of the pivot 24 and also is rockable relative to the kiln and the lid about the axis formed by the pin 27.

As is best shown in FIG. 1 the lid 4 and the arm 21 are substantially parallel when the lid is closed. The link 26 bridges the space between the lid 4 and the lift arm 21 and occupies a position which substantially parallels the imaginary line joining the pivot pins 7 and 24, and the distances $D_1$ and $D_2$ are substantially the same. The geometry is such that the effect of the arrangement is like a parallelogram.

At that end of the arm 21 opposite the pivot pin 27 is an anchor post 28 to which corresponding ends of a pair of counterbalance springs 29 are connected. Opposite ends of the springs are connected to a similar anchor post 30 that is carried by the support 20.

When the apparatus is in condition for operation the lid will be closed, the arm 21 will overlie the lid, and the link 26 will be coupled to the closure lid and to the lifter arm. The kiln body 2 will be seated on the base 15 and abut the bracket 19. See FIG. 1. When the lid 4 is in its closed position the arm 21 is substantially parallel to the lid.

To move the lid 4 to its open position, a lifting force may be applied manually or otherwise to the coupling rod 9. Such force will be imparted to the lid 4 via the link 26 thereby effecting conjoint rocking movement of the lid 4 and lift arm 21 about the first and second pivot axes 7 and 24, respectively. As the lid 4 and the arm 21 rotate about their respective pivot axes the link 26 will rock clockwise about the pivot pin 27 from the position shown in FIG. 1 to the position shown in FIG. 3. As a consequence, there will be relative linear movement of the lid 4 and arm 21 in such manner that the pivot axis of the rod 9 will move from a position (FIG. 1) in which it is beyond the free end of the arm 21 to a position (FIG. 3) in which the free end of the arm 21 extends beyond the free end of the lid 4. During such movement the lid 4 and arm 21 will remain virtually parallel, thereby avoiding the imposition of any significant stress on the lid 4, the arm 21, their respective pivots, or the kiln body 2. Such movement of the lid 4 and arm 21 to their raised positions will be assisted by the counterbalance springs 29.

As shown in the drawings the linear movement of the lid 4 relative to the lift arm requires the link 26 to rock, thereby causing the rod 9 to partake of slight vertical movement. Such vertical movement may be eliminated in known manner by the provision of a short slot in the lower end of the link through which the rod 9 passes.

The lid 4 and arm 21 may be returned to the positions shown in FIG. 1 simply by applying a sufficient downward force on the free end of the arm 21 to overcome the force of the counterbalance springs 29.

To minimize the possibility that the closure member 3 inadvertently may return from its open position to its closed position, the stabilizer bar 10 may be adjusted so that the retainer 12 is accommodated in the notch 13. The lid 4 thus will be propped in its open position. The bar 10 may be adjusted to withdraw the retainer from the notch when it is desired to return the lid to its closed position.

The disclosed embodiment is representative of a presently preferred form of the invention, but is intended to be illustrative rather than definitive thereof. The invention is defined in the claims.

We claim:

1. A lid lift apparatus for use with a kiln having a body within which is a chamber to which access may be had via an opening, the body including a closure pivotable via a pivot assembly about a first axis between first and second positions in which the closure respectively closes and opens the opening, the lid lift apparatus comprising a lift arm; an upright support adjacent to the body that mounts the lift arm in a position spaced away from the closure and for movements about a second axis vertically and laterally spaced from the first axis; and the vertical spacing between the first and second axes and between the lift arm and the closure being substantially the same, the upright support mounted on a base on which the kiln may be supported, wherein the upright support is not supported by the body of the kiln.

2. The lid lift apparatus of claim 1 wherein the lift arm and the closure are substantially parallel to one another in all positions of the lift arm wherein the kiln lift apparatus is not connected to the pivot assembly between the body and closure.

3. The lid lift apparatus of claim 1 further comprising a coupling between the lift arm and the closure for rocking movements of the lift arm relative to the closure, the coupling bridging the space between the closure and the lift arm, wherein the coupling comprises a link having two ends and being pivoted at one end to an opening end of the closure and at the other end to the lift arm wherein the link at a distal edge of the closure couples to a coupling rod; and a first bracket and a second bracket for accommodating the coupling rod between the brackets so that each bracket attaches to the closure farther out than the lift arm at opposite ends of the coupling rod.

4. The lid lift apparatus of claim 1 including a counterbalance spring reacting between the lift arm and the upright support for balancing the closure and the lift arm wherein the counterbalance spring is not connected to the body or the pivot assembly between the body and closure of the kiln.

5. The lid lift apparatus of claim 2 wherein the closure overlies the body when the closure is in the first position and the lift arm substantially parallels the base.

6. The lid lift apparatus of claim 5 wherein the space between the lift arm and the closure is substantially uniform in all positions of the lift arm and the closure.

7. The lid lift apparatus of claim 2 wherein the upright support extends below the body of the kiln to the base and extends above the body to the lift arm.

8. A lid lift apparatus with a kiln having a body within which is a chamber to which access may be had via an opening, the body including a closure rockable about a first axis via a pivot assembly between first and second positions in which the closure respectively closes and opens the opening, the lid lift apparatus having a lift arm; an upright support adjacent to and independent of the body mounting the lift arm in a position overlying, and spaced from the closure and for rocking movements conjointly with the closure about a second axis vertically and laterally spaced a fixed distance from the first axis; and a coupling between the lift arm and the closure for substantially linear movements of the closure relative to the lift arm, the coupling bridging the space between the closure and the lift arm, the vertical spacing between the first and second axes and between the lift arm and the closure being substantially the same, whereby the vertical spacing between the lift arm and the closure remains substantially uniform during the substantially linear movements of the closure relative to the lift arm wherein the upright support is not connected to the pivot assembly between the body and closure.

9. The lid lift apparatus of claim 8 wherein the lid lift apparatus is not supported by the body of the kiln.

10. The lid lift apparatus of claim 8 wherein the coupling comprises a link having two ends, the link being pivoted at one end to an opening end of the closure via a rod and brackets and at the other end to the lift arm via a first pivot pin.

11. The lid lift apparatus of claim 8 including a counterbalance spring reacting between the lift arm and the upright support for balancing the lift arm and the closure wherein the counterbalance spring is not connected to the pivot assembly or the body of the kiln.

12. The lid lift apparatus of claim 8 further having a base under and supporting the body, and the upright support extending from the base and extending above the body.

13. The lid lift apparatus of claim 8 wherein the first and second axes are spaced apart along an imaginary line inclined to the vertical, and wherein the coupling includes a link via a rod and distal brackets attached to the closure and the lift arm and extending substantially parallel to the imaginary line when the closure occupies the first position, wherein the distal brackets are attached to the closure farther out than the lift arm at opposite ends of the rod.

14. The lid lift apparatus of claim 13 wherein the coupling includes the link pivoted at opposite ends thereof to an opening end of the closure and to the lift arm via a first pivot pin and wherein the pivot assembly between the body and the closure includes a second pivot pin and two assembly-closure brackets accommodating the second pivot pin, wherein the distal brackets and the assembly-closure brackets each attach to the closure on different quadrants of the closure.

15. A kiln having a body and a lid pivotably connected to the body via a pivot assembly, wherein the body is supported on top of a base, the improvements including a lift apparatus for the lid comprising an upright support attached to the base, a top end of the upright support extending higher than the body, a lifting arm pivotably attached to the upright support on the top end and pivotably coupled to the lid, wherein the upright support is adjacent to the body and not connected to the pivot assembly, and wherein the lifting forces are exerted on the base and lid lifting stress is avoided on the body.

16. The kiln of claim 15 wherein the lifting arm is pivotably coupled to the lid by a link pivoted to the lid by a rod centered between a first bracket and a second bracket and to the lifting arm by a pivot pin so the lifting arm and lid are capable of movement relative to each other that is substantially parallel and each bracket attaches to the lid outside the lifting arm at opposite ends of the rod.

17. The kiln of claim 15 wherein a lower end of the upright support extends below the body to attach to the base.

18. The kiln of claim 15, wherein the lifting arm is substantially planar and extends on both sides of a pivot pin at the pivotal attachment to the upright support, wherein the lifting arm does not directly touch the lid, wherein the upright support does not attach to the body.

19. The kiln of claim 15 wherein a lower end of the upright support extends below the body to attach to the base and the upright support does not attach to the body, and opening the lid transfers stress through the upright support to the base supporting the body of the kiln, avoiding imposing appreciable stress on the arm, the body and the lid.

20. The kiln of claim 15 wherein the base has a support member on which the body rests and has supporting legs and a member that provide support for a bracket from which the upright support extends to a level above the lid.

* * * * *